US008390801B2

(12) United States Patent
Streuber

(10) Patent No.: US 8,390,801 B2
(45) Date of Patent: Mar. 5, 2013

(54) ANGLE MEASUREMENT FOR A WIDE FIELD-OF-VIEW (WFOV) SEMI-ACTIVE LASER (SAL) SEEKER

(75) Inventor: Casey T. Streuber, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 301 days.

(21) Appl. No.: 12/913,945

(22) Filed: Oct. 28, 2010

(65) Prior Publication Data

US 2012/0105832 A1 May 3, 2012

(51) Int. Cl.
*G01B 11/26* (2006.01)

(52) U.S. Cl. ..... 356/138

(58) Field of Classification Search ..... 356/138
See application file for complete search history.

(56) References Cited

U.S. PATENT DOCUMENTS 7,227,116 B2 6/2007 Gleckler
7,433,042 B1 * 10/2008 Cavanaugh et al. ..... 356/419

* cited by examiner

*Primary Examiner* — Roy M Punnoose
(74) *Attorney, Agent, or Firm* — Eric A. Gifford

(57) ABSTRACT

A SAL seeker focuses laser energy reflected off a target into a spot on the surface of a multi-segment non-imaging detector. A matched filter is responsive to the normalized detector response to estimate an angle measurement to the target. The matched filter is particularly well-suited for use in wide FOV systems as it unambiguously selects the angle measurement over the extended FOV whereas the conventional centroid calculation introduces ambiguity. The centroid calculation and angle selection may be used to improve the search and selection of the matched filter. Alternately, the matched filter may be used to disambiguate the angle selection based on the centroid calculation.

23 Claims, 10 Drawing Sheets

$$\Delta X = \frac{(A+D) - (B+C)}{A+B+C+D}$$

$$\Delta Y = \frac{(A+B) - (C+D)}{A+B+C+D}$$

1002

1000

ANGLE MEASUREMENT FOR A WIDE FIELD-OF-VIEW (WFOV) SEMI-ACTIVE LASER (SAL) SEEKER

BACKGROUND OF THE INVENTION

1. Field of the Invention

This invention relates to guided projectiles that engage targets by detecting and following laser light scattered from the targets, and more particularly to angle measurement for a wide field-of-view (WFOV) semi-active laser (SAL) seeker.

2. Description of the Related Art

Laser guided ordinance is commonly used to engage point targets with a high probability of success and minimal collateral damage. Such ordinance includes guided artillery projectiles, guided missiles, and guided bombs, all of which will be referred to herein as "projectiles".

A laser guided projectile's guidance system typically includes a semi-active laser (SAL) seeker to detect pulsed laser electro-magnetic radiation (EMR) scattered from the intended target and to provide signals indicative of the target bearing and a flight controller that processes the signals to manipulate one or more control surfaces (e.g. fins or canards) to guide the projectile to the target. The SAL seeker includes a non-imaging optical system that captures and focuses the scattered laser EMR into a spot onto a segmented non-imaging detector (e.g. a quad-cell detector). As the target bearing changes the position of the spot on the detector changes. The detector compares the integrated EMR incident on each cell (segment) to calculate a spatial displacement of the centroid of the spot. The effective field-of-view (FOV) is dictated by the central monotonic region of the detector's spatial transfer function (STF) in which the spot is incident on all four cells, which is in turn determined by the spot size. The detector's central monotonic region is commonly referred to as the "linear" region.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

Optical techniques for increasing spot size to widen the linear region of the STF and the FOV of the seeker also create a rollover in the STF and an ambiguity in an extended FOV beyond the linear region. The extended FOV contains information of the angle measurement to the target but because of the ambiguity is considered unusable. In most tactical situations, the effective extended FOV is relatively small and may be thresholded to preserve a wide linear region. Thresholded measurements may still provide a direction to the guidance system but not a precise angle measurement.

In certain tactical situations, the target presents itself at large angles at close range whereby the effective extended FOV is large. In this scenario thresholding is not viable, too much of the linear region would be sacrificed and a simple direction guidance signal is insufficient at close range.

The present invention provides unambiguous angle measurement over a wide FOV including the extended FOV for a SAL seeker. This is accomplished with a matched filter having weights corresponding to the normalized response of the SAL detector for angles spanning the wide FOV. The matched filter is responsive to measures of incident EMR detected by the detector cells to select an angle measurement to the target. The matched filter effectively disambiguates the angle measurement in the extended non-monotonic (double-valued) region of the spatial transfer function corresponding to the centroid calculation. The use of the matched filter is particularly useful for fixed-post projectiles but may also be used with gimbaled optical systems.

In an embodiment, the matched filter may replace the centroid calculation entirely. In theory, the matched filter should provide better resolution of the angle measurements because the matched filter has an additional degree of freedom as compared to the centroid calculation. The matched filter would search its table to find the set of weights, hence angle measurement that most closely matches the normalized detector response. Hybrid detectors using both the sum/difference processing of the centroid calculation and the matched filter are also possible to improve the efficiency of selecting the angle measurement or to provide higher resolution measurements. For example, the centroid calculation may be used to identify the double-valued angle measurements to constrain the search of the matched filter. Alternately, a relatively low-resolution matched filter may be used to disambiguate the double-valued angle measurements for a relatively high-resolution calibrated angle measurement table for the centroid calculation. The appropriate system configuration will be driven by the tactical situation, on-board processing resources, the resolution and angle extent of the matched filter and the resolution and angle extent of the calibrated angle measurement table for the centroid calculation.

These and other features and advantages of the invention will be apparent to those skilled in the art from the following detailed description of preferred embodiments, taken together with the accompanying drawings, in which:

DETAILED DESCRIPTION OF THE INVENTION

Optical techniques for increasing spot size to widen the linear region of the STF and the FOV of the seeker also create a rollover in the STF and an ambiguity in an extended FOV beyond the linear region. The extended FOV contains information of the angle measurement to the target but because of the ambiguity is considered unusable. In most tactical situations, the effective extended FOV is relatively small and may be thresholded to preserve a wide linear region. Thresholded measurements may still provide a direction to the guidance system but not a precise angle measurement.

In certain tactical situations, the target presents itself at large angles at close range whereby the effective extended FOV is large. In this scenario thresholding is not viable, too much of the linear region would be sacrificed and a simple direction guidance signal is insufficient at close range. The present invention provides unambiguous angle measurement over a wide FOV including the extended FOV for a SAL seeker. This is accomplished with a matched filter having weights corresponding to the normalized response of the SAL detector for angles spanning the wide FOV. The matched filter is responsive to measures of incident EMR detected by the detector cells to select an angle measurement to the target. The matched filter effectively disambiguates the angle measurement in the extended non-monotonic (double-valued) region of the spatial transfer function corresponding to the centroid calculation. The matched filter may be used alone or in combination with the centroid calculation. The appropriate system configuration will be driven by the tactical situation, on-board processing resources, the resolution and angle extent of the matched filter and the resolution and angle extent of the calibrated angle measurement table for the centroid calculation.

Figure 1:
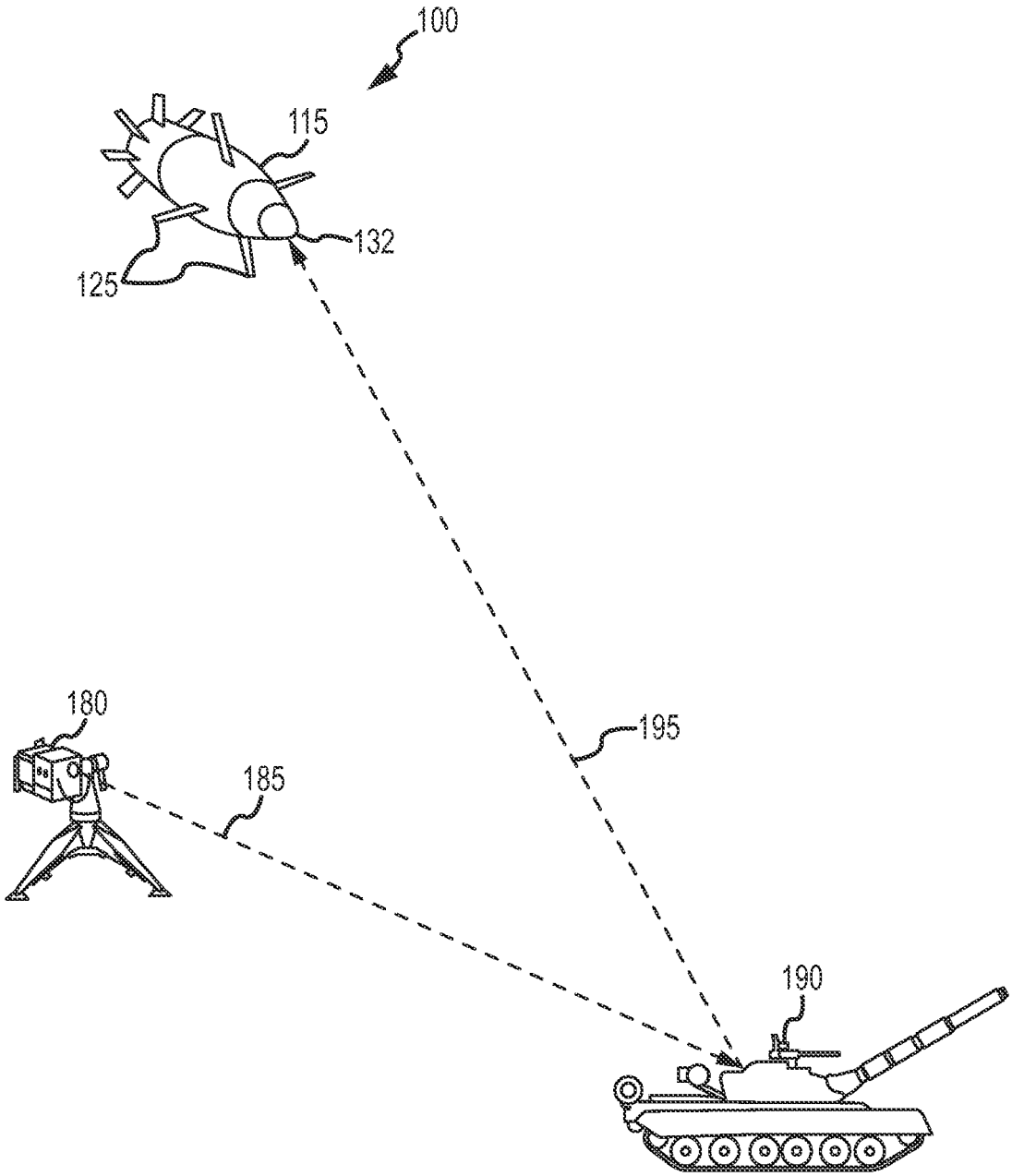
FIG. 1 is a schematic illustration of a laser-guided projectile engaging a target.

Referring now to FIG. 1, a laser guided projectile 100 may engage a target 190 by detecting and following scattered laser radiation 195 from the target 190. In FIG. 1, the target 190 is represented as a tank, but may be another type of vehicle, ship, boat, or a structure, building or other stationary object. The target 190 may be illuminated with laser radiation 185 from a laser designator 180. The laser designator 180 may be located on the ground, as shown in FIG. 1, or may be located in a vehicle, ship, boat, or aircraft. The laser designator could be located on the projectile itself. This is typically referred to as an active laser seeker. The scattered laser radiation 195 is a portion of the illumination laser radiation 185.

The laser-guided projectile 100 may include a projectile body 115, control surfaces 125, and a guidance system. The guidance system may include a SAL seeker, of which only a transmissive dome 132 is visible in FIG. 1. The guidance system may include a flight control system to control the flight of the laser guided projectile 100 by manipulating one or more control surfaces 125 based on at least one guidance signal from the SAL seeker. In the example of FIG. 1, the control surfaces 125 are shown as canards, but may be fins, wings, ailerons, elevators, spoilers, flaps, air brakes or other controllable devices capable of affecting the flight path of the laser guided projectile 100.

Figure 2:
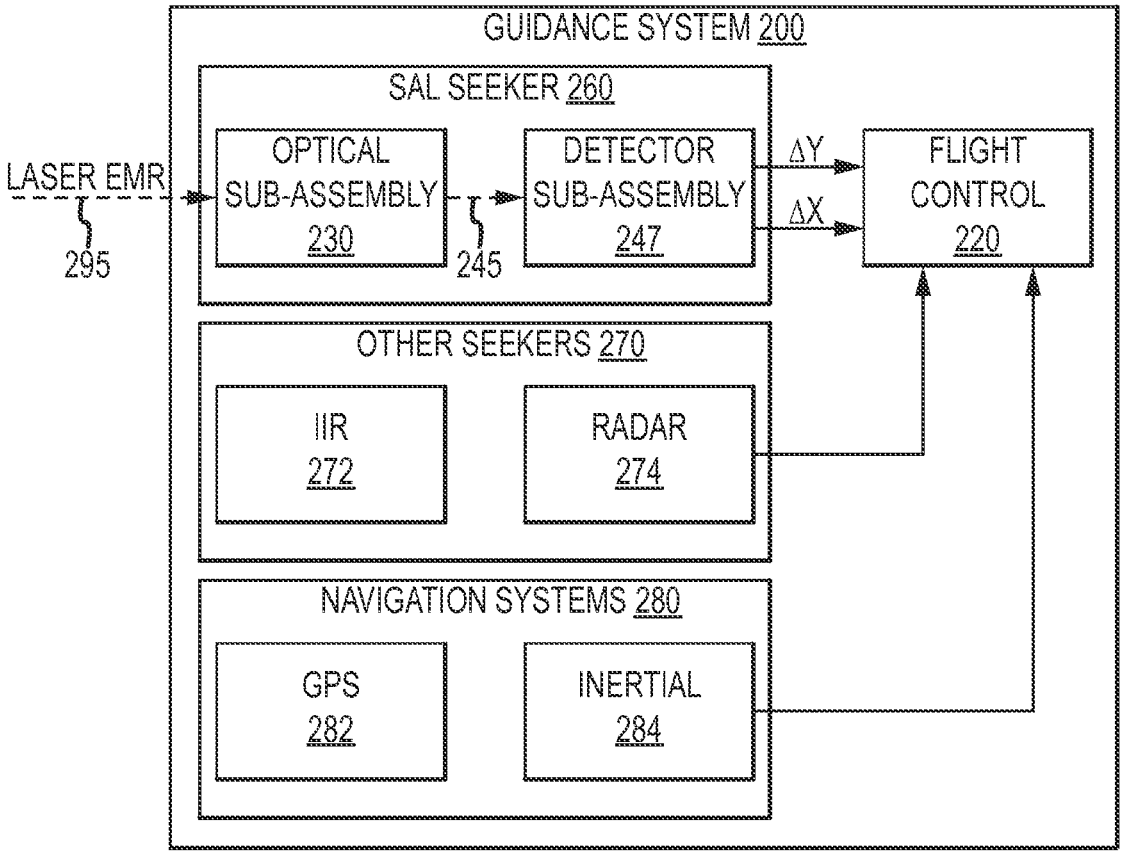
FIG. 2 is a block diagram of a guidance system.

Referring now to FIG. 2, a guidance system 200, which may be suitable for use in the projectile 100, may include a SAL seeker 260 and a flight control system 220. The SAL seeker 260 may include an optical sub-assembly 230 to capture and condense or focus laser EMR 295 scattered from a target to form an irradiance distribution or laser light "spot" 245 on a detector sub-assembly 247 including a detector 250. The SAL seeker 260 may provide a guidance signal indicative of a position of the laser light spot. The guidance signal may include signals ΔX and ΔY which are indicative of the position of the laser light spot 245 along two orthogonal axes. The position of the spot on the detector is indicative of the target bearing relative to the axis of the SAL seeker. The target bearing is represented as an angle measurement.

The guidance system 200 may optionally include one or more additional seekers 270, such as an imaging infrared (IIR) seeker 272 and/or a radar seeker 274. The guidance system 200 may optionally include one or more navigation systems 280, such as a global positioning system (GPS) 282 and/or an inertial navigation system 284.

The flight control system 220 may receive at least one guidance signal from the SAL seeker 260. The flight control system 220 may also receive guidance signals from the additional seekers 270 and navigations systems 280 when present. In response to the guidance signals, the flight control system 220 may control the flight of the projectile such that the projectile arrives at a designated target.

The flight control system 220 may include one or more processors that accept at least one guidance signal from the SAL seeker and generate control signals to control the flight or trajectory of a projectile such as the projectile 100. The flight control system 220 may include control actuators to convert the control signals into physical movements of control surfaces such as the canards 125 shown in FIG. 1.

Figure 3A:
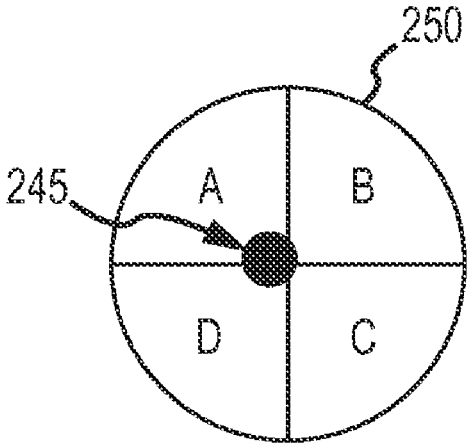
FIGS. 3*a* and 3*b* are an embodiment of a quad-cell detector and its spatial transfer function.

FIG. 3*a* shows a frontal view of the detector 250 and the focused laser spot 245. The detector 250 may comprise a "quad-cell" detector including four quadrants or "segments" A, B, C, D. Other detector configurations including multiple segments may be used. Each quadrant may produce a corresponding signal A, B, C, and D in response to the integrated laser power incident upon each quadrant. Guidance signal ΔX may indicate an imbalance between the laser power incident upon the left (quadrants A and B) and right (quadrants C and D) halves of the detector 250. Guidance signal ΔY may indicate an imbalance between the laser power incident upon the top (quadrants A and C) and bottom (quadrants B and D) halves of the detector 250. The terms "left", "right", "top", and "bottom" refer to the detector 250 as shown in FIG. 3*a* and do not imply any physical orientation of the detector 250 within a projectile such as the projectile 100. When the laser spot 245 is centered on the detector 250, the signals A, B, C, D may be essentially equal and the guidance signals ΔX and ΔY may both be zero or nearly zero.

More particularly, the detector 250 may effectively measure the centroid of the incident EMR on the detector 250. The spatial transfer function (STF) 255 is a ratio of the laser power on the different quadrants of the detector. When laser power in spot 245 is hitting all four quadrants A-D, the guidance system operates in a linear region (or more generally a "monotonic" region) 260 of the transfer function 255. Within the linear region $\Delta X=((A+D)-(B+C))/(A+B+C+D)$ and $\Delta Y=((A+B)-(C+D)/(A+B+C+D)$ where A, B, C and D are integrated laser power incident on the respective cells. The transfer function 255 in the linear region 260 determines the angle of the guidance system from the target (e.g. target bearing). The quad-cell detector is calibrated with a known target that is moved from position-to-position over the useable FOV to create a table that maps the value of the STF (i.e. the displacement) to target angle. When laser power is hitting only two quadrants, the guidance system operates outside the linear region, where the transfer function nears +/−1. The guidance system only knows the direction towards the target, but not its true angle.

The size of the spot 245 may affect the performance of the guidance system. For example, a small spot tends to move off of overlapping multiple detector areas faster than a big spot. In the present application a larger spot improves the transfer function by making a relatively wide transfer function, hence wide FOV. As will be described, the optical techniques for increasing the spot size both increase the linear or monotonic region 260 and create a non-monotonic or double-valued region in an extended FOV. The present invention provides techniques to disambiguate angle measurement in the non-monotonic or "double-valued" regions to effectively further widen the monotonic region of the spatial transfer function and the FOV.

The position of SAL seeker 260 may be fixed within a projectile such as the projectile 100. This may be referred to as "fixed post" or "body fixed". For example, the SAL seeker 260 may be disposed within the projectile 100 such that an optical axis of the SAL seeker 260 is aligned with a longitudinal axis of the projectile 100. In this case, the laser spot 245 may be centered on the detector 250 when the longitudinal axis of the projectile 100 is pointed directly at the designated target. The SAL seeker 260 may be mounted on a gimbal within the projectile 100 such that the optical axis of the SAL seeker 260 may be rotated with respect to the longitudinal axis of the projectile 100. In this case, the laser spot 245 may be centered on the detector 250 when the optical axis of the SAL seeker 260 is pointed directly at the designated target without the longitudinal axis of the projectile necessarily being pointed directly at the designated target.

Figure 4:
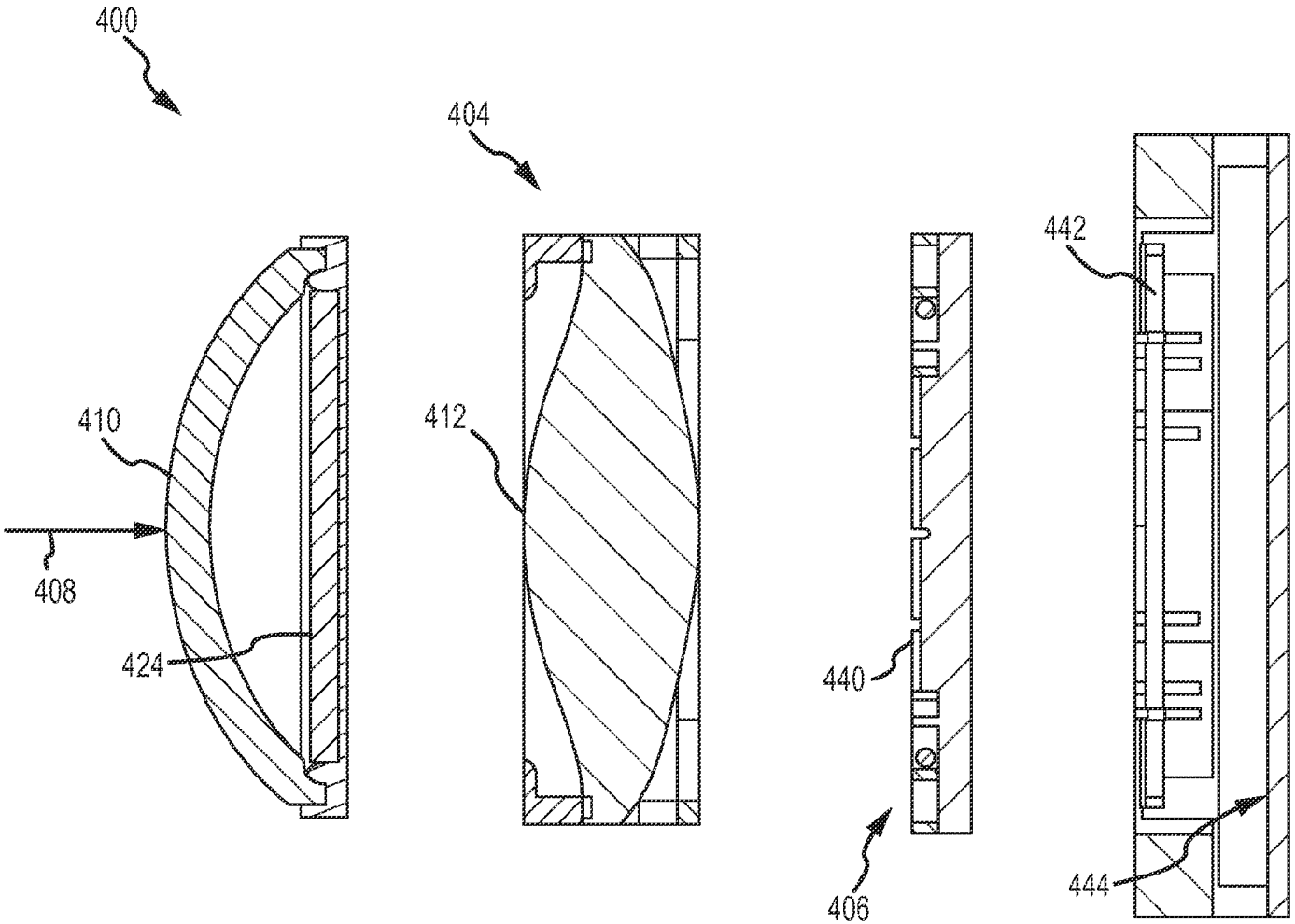
FIG. 4 is a diagram of an optical system for a WFOV seeker of a laser-guided projectile.

Referring now to FIG. 4, an exemplary guided projectile may include a WFOV SAL seeker 400 mounted on a projectile body behind a transmissive dome 410. The SAL seeker provides angle measurements to a target. A flight controller (not shown) is responsive to those angle measurements to generate control signals to manipulate one or more control surfaces to fly the projectile to the target.

Dome 410 may be made of a transmissive material having sufficient mechanical integrity and abrasion resistance to withstand the launch and flight of the projectile. The term "transmissive" means that an element, such as the dome 410, transmits a substantial portion, though not necessarily all, of incident light at a specific wavelength or wavelength band of interest. The detection band may span a range of 0.35 microns to 15 microns. The wavelength typically used for laser target designators is 1.06 microns although other wavelengths may be used. For example 1.55 microns may be used. The dome 410 may be made, for example, of glass, plastic, sapphire, aluminum oxynitride, ZnS, or other transmissive material. The dome 410 may be an essentially spherical shell having a concave outer surface essentially concentric with a concave inner surface. In this context and similar contexts, the term essentially is intended to mean "within reasonable manufacturing tolerances". The dome 410 may have a non-spherical shape such as an ogive selected, for example, to improve the aerodynamic performance of the projectile.

SAL seeker 400 comprises an optical sub-assembly 404 and a detector sub-assembly 406. The optical sub-assembly may be disposed to receive EMR 408 from a laser scattered off a target through transmissive dome 410. The optical sub-assembly 404 focuses incident laser energy reflected off a target into a spot and converts target bearing to a spatial displacement of the laser spot or centroid of the incident EMR at the detector plane. The detector sub-assembly 406 senses spatial displacements of the laser spot and generates corresponding position, hence angle measurement signals. The optical sub-assembly 404 and the detector sub-assembly 406 may be affixed to the projectile body as shown or may be mounted on a one or two-axis gimbal, which allows the optical sub-assembly 404 and the detector sub-assembly 406 to collectively rotate about one or more axes that typically pass through the center of curvature of dome 410.

Optical sub-assembly 404 comprises one or more optical elements 412 that together focus incident EMR into a spot at the detector plane and convert angle to target to a spatial displacement of the spot in the detector plane. The primary optical element may, for example, be a positively-powered lens or mirror, an aspheric positively-powered lens or mirror, a Fresnel lens or a Fresnel lens formed on a positively-powered surface. The assembly may include optical elements such as a filter to reject EMR outside the desired detection band and lenses configured to control aberration characteristics of the EMR.

Optical sub-assembly 404 also includes a spreader 424 at the entrance pupil of the optical system configured to spatially homogenize the EMR. This effectively increases the spot size at the detector plane, which in turn increases the linear or monotonic region of the STF and FOV of the seeker. Thinking of EMR as a wave incident on the detector, the spreader 424 may comprise any suitable system for spatially homogenizing or intermixing various portions of the incident EMR wave received by the detector. For example, the spreader may comprise a diffuser, a lenslet array, a "wavy" surface, a diffractive optical element, or other optical spreading element. In various embodiments, the spreader spatially homogenizes the incident EMR by transmitting the EMR through an input aperture comprising a diffuser or multiple relatively small lenses ("lenslets") to overlap various portions of the incident EMR wave received by the detector. The angular spread of the spreader affects the range of the linear region of the spatial transfer function. Thus, the spreader may be configured to deliver a selected width of the linear region of the transfer function over desired signal collection angles.

Detector sub-assembly 406 comprises a multi-segment detector 440 such as the quad-cell detector (e.g. quad-cell photodiode) shown in FIG. 3*a* coupled to the optical sub-assembly and configured to generate at least one angle measurement signal in response to the focused EMR. The multi-segment detector may have any number of segments (greater than one) that each output a measure of integrated incident laser energy on that segment. The quad-cell detector is the norm as four-segments is the minimum required to resolve both the elevation (El) and azimuth (Az) angles. The detector sub-assembly may comprise a field lens. The detector 440 may be mounted on the backside of the field lens to immerse the detection surface. This increases the apparent size of the detector thus effectively increasing the FOV. The assembly may also include an analog circuit card assembly 442 and a digital circuit card assembly to process the measured EMR to generate the guidance signal.

Figure 3B:
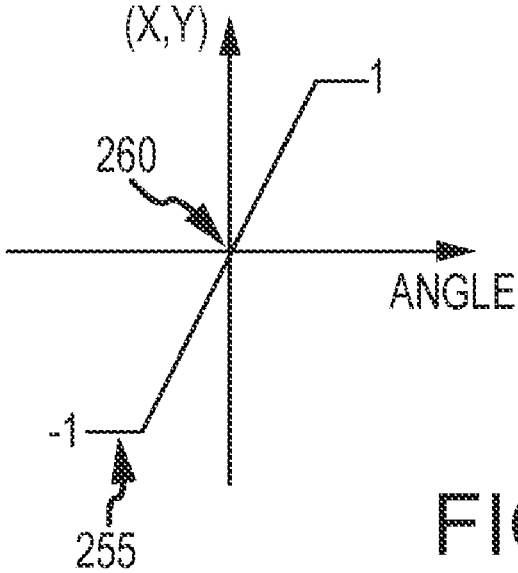
Figure 5:
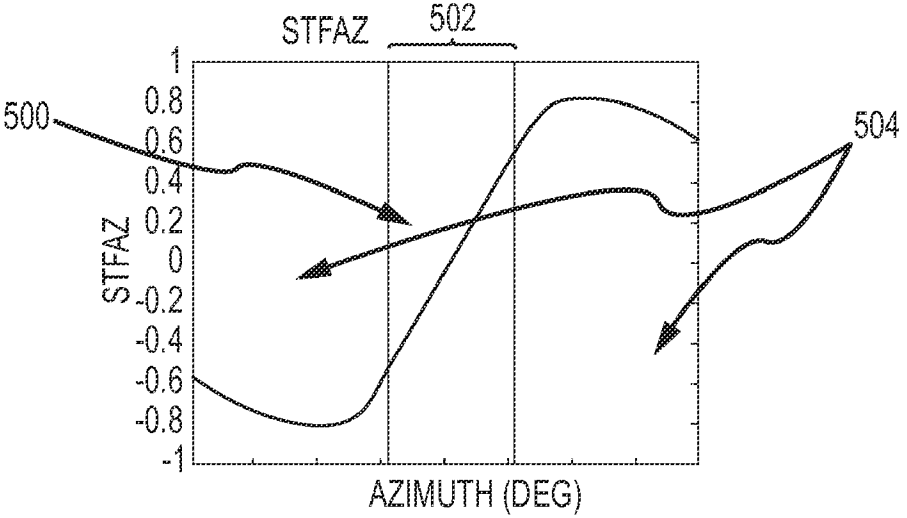
FIG. 5 is a diagram of the spatial transfer function for the WFOV seeker including central monotonic and double-valued regions and thresholding scheme that removes the double-valued regions.

An exemplary STF 500 for a WFOV quad-cell detector is illustrated in FIG. 5. As compared to the STF of FIG. 3*b*, the linear or monotonic region 502 has widened. Outside this region in an extended FOV, the STF exhibits an extended non-monotonic or "double-valued" region 504 in which the STF reaches an apex and rolls over. In this extended FOV, the detector does provide information regarding the angle measurement to the target, however the measurement is ambiguous. This roll-over in the STF and the resultant ambiguity is directly attributable to the spreader. At large angles off detector boresight, stray light begins to leak through the optical sub-assembly. The amount of stray light increases with angle.

The STF slope begins to degrade until it reaches an apex and then descends producing the double-valued region. The quad-cell detector uses sum and difference processing to compute the centroid of the spot. Because the centroid is a weighted average of all the incident energy there is now way to exclude the stray light from the computation.

In almost all tactical situations, if the angle measurement to the target is relatively large, large enough to fall outside the linear region, it is reasonably assumed that the range to the target is relatively far. From a guidance perspective this has two advantages. First, the width of the effective double-valued region 504 is limited as shown in FIG. 5. Thus the double-valued region may be thresholded to preserve a wide linear region 502 e.g. for STF magnitudes>0.6 do not return an angle measurement, only a directional flag. Thresholded measurements may still provide a direction to the guidance system but not a precise angle measurement. Second, because the range to target is relatively far a directional guidance signal is sufficient for the projectile to maneuver to place the target within the linear region. Consequently, in these situations the roll-over in the STF can be easily dealt with by limiting the usable linear FOV with a threshold that declares all points above threshold out of the linear FOV. This avoids any confusion between the doubly valued regions of the STF curve.

Figure 6:
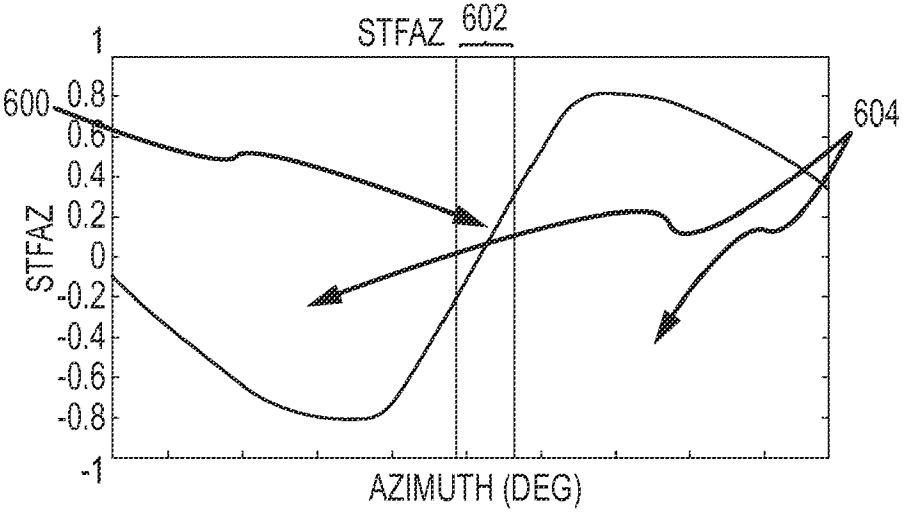
FIG. 6 is a diagram of the spatial transfer function for the WFOV seeker for a tactical situation in which the thresholding scheme is not viable.

In certain tactical situations, the target presents itself at large angles at close range whereby the effective extended FOV is large. As shown in FIG. 6, in such a situation the detector's STF 600 has a very small linear region 602 and wide double-valued region 604. In this scenario thresholding is not viable, too much of the linear region would be sacrificed and a simple direction guidance signal is insufficient at close range. In addition, because the slope has not gone to zero except at the apex of the STF curve, there is information on the other side of the apex that can be used to calculate an accurate LOS angle. For both of these reasons, it is important to devise a way to unambiguously separate the double-valued regions of the STF curve algorithmically. In addition, while IMU data is typically collected in the course of missile guidance, it would be beneficial to create an algorithm that does not include this information in order to make it robust in a variety of target and flight environments.

The present invention provides unambiguous angle measurement over a wide FOV including the extended FOV for a SAL seeker. This is accomplished with a matched filter having weights corresponding to the normalized response of the SAL detector for angles spanning the wide FOV. The matched filter is responsive to measures of incident EMR detected by the detector cells to select an angle measurement to the target. The use of the matched filter is particularly useful for fixed-post projectiles but may also be used with gimbaled optical systems. The matched filter is also particularly useful for tactical situations in which accurate angle measurements to a target at close range at large angles off boresight are required. However, the matched filter may be used in other tactical scenarios to extend the FOV. This may be true for optical systems that employ a spreader to widen the FOV or for systems that do not employ a spreader but have similar roll-over issues do to stray light.

Figure 7:
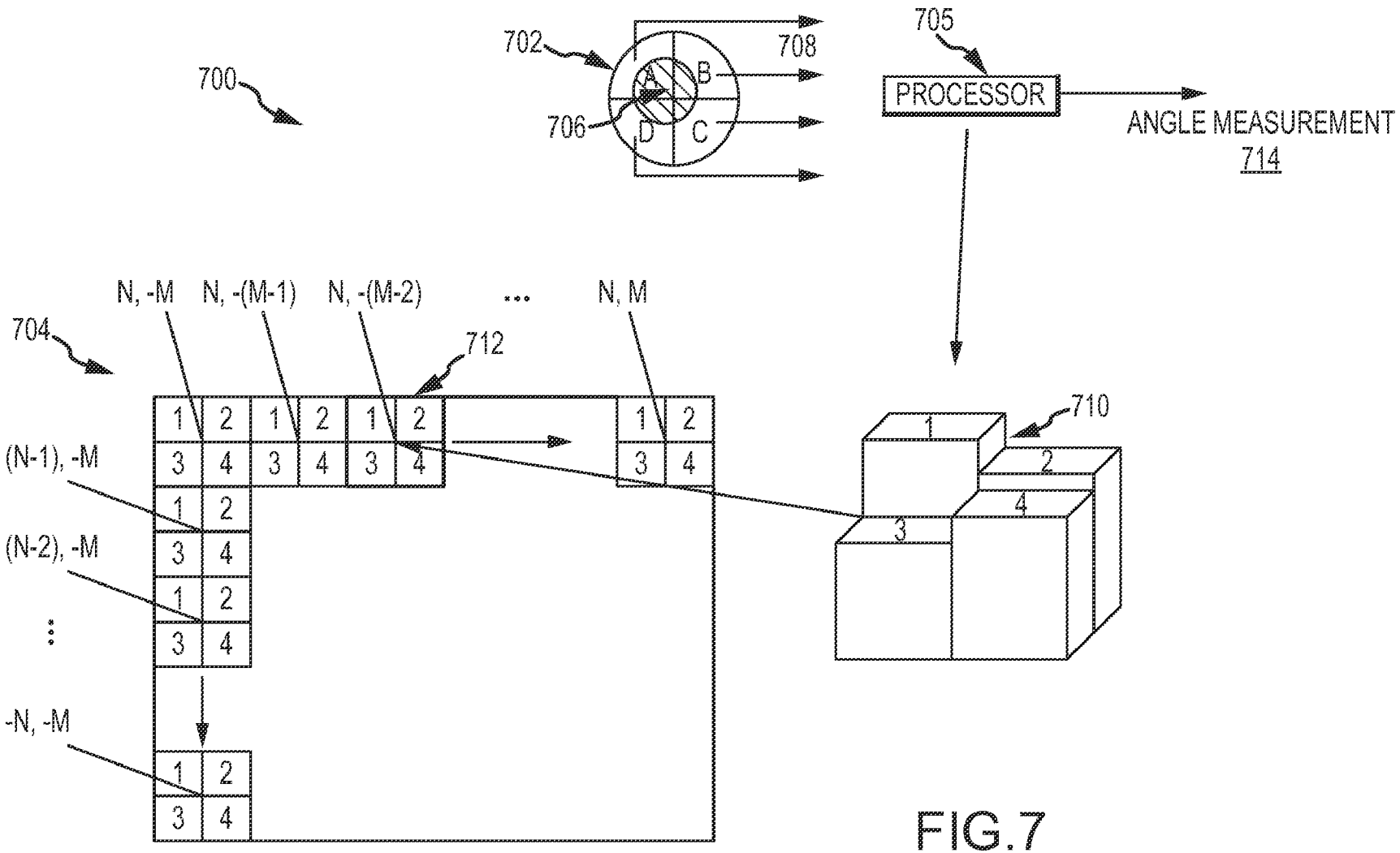
FIG. 7 is a diagram of a matched filter and its application to unambiguously select an angle measurement for a quad-cell detector.

As shown in FIG. 7, an embodiment of a SAL detector 700 includes a multi-segment detector 702 such as a quad-detector, a matched filter 704 and a processor 705. Each segment of detector 702 is responsive to incident laser energy in laser spot 706 (reflected off a target) to output a measure 708 of the integrated laser energy. Matched filter 704 is a table comprised of the normalized response (weights) of the multi-segment detector for a plurality of Azimuth and Elevation angles over a calibrated FOV. The table may be built by moving a target across the FOV to each of the angles and measuring the normalized response at each angle. In this embodiment, N measurements are made in the Azimuth angle and M measurements are made in the Elevation angle. Each entry in the table has four weights, once for each segment of the quad-cell detector. Each entry may be considered to be a component matched filter of the Matched Filter. The performance of the matched filter will improve as the number of segments in detector increases. The table is stored in memory.

The angle resolution of the matched filter table 704 may be uniform across the FOV. Alternately, the resolution may be increased near the boundaries of the segments. As the spot centroid approaches the boundaries of the segmented regions, the matched filter begins to lose a degree of freedom. Because two channels are nearly identical in signal, determining which one is the maximum for amplitude normalization becomes noisy. This means the matched filters themselves will be noisy in this region as well. As the noise increases in relation to the signal at large measurement angles, this channel border region becomes more problematic leading to a higher false alarm rate. In order to minimize this effect, more densely spaced samples are collected in this region when generating the matched filter table. This is an attempt to minimize the measurement noise by oversampling it.

During flight, the output measures 708 are suitably read out at specified time interval. If the target signal (e.g. maximum output measure) exceeds a track threshold, processor 705 processes the measures to estimate an angle measurement to the target. Processor 705 normalizes measures 708 by dividing each measure by the largest measure to produce normalized response 710. Processor 705 searches the matched filter table 704 to select the entry 712 that most closely matches normalized response 710. The processor may constrain its search to the angle quadrant corresponding to the cell with the largest response as the spot will lie in that quadrant. The processor than outputs the Az/El angle pair associated with that entry as the angle measurement 714. As will be described, varying techniques may be used to improve the efficiency of searching the matched filter table and varying techniques may be used to generate a final angle measurement that is provided as a guidance signal to the flight control system.

The processor may select the matched filter that most closely matches the normalized response in different ways. The first common step is to compute the absolute difference between the normalized response and the matched filter for each segment. A conventional matched filter would then form a product of the absolute differences, generally referred to as a "cross-correlation", and select the smallest product. An alternate approach is to sum the absolute differences and select the smallest product. Another approach is to use a root sum square of differences metric between the weights and the measured normalized response for each segment. It is known to those skilled in the art that there are a variety of algorithms for scoring the performance of a matched filter, and the description of methods above for performing this task are not meant to limit the scope of the invention.

Figure 8:
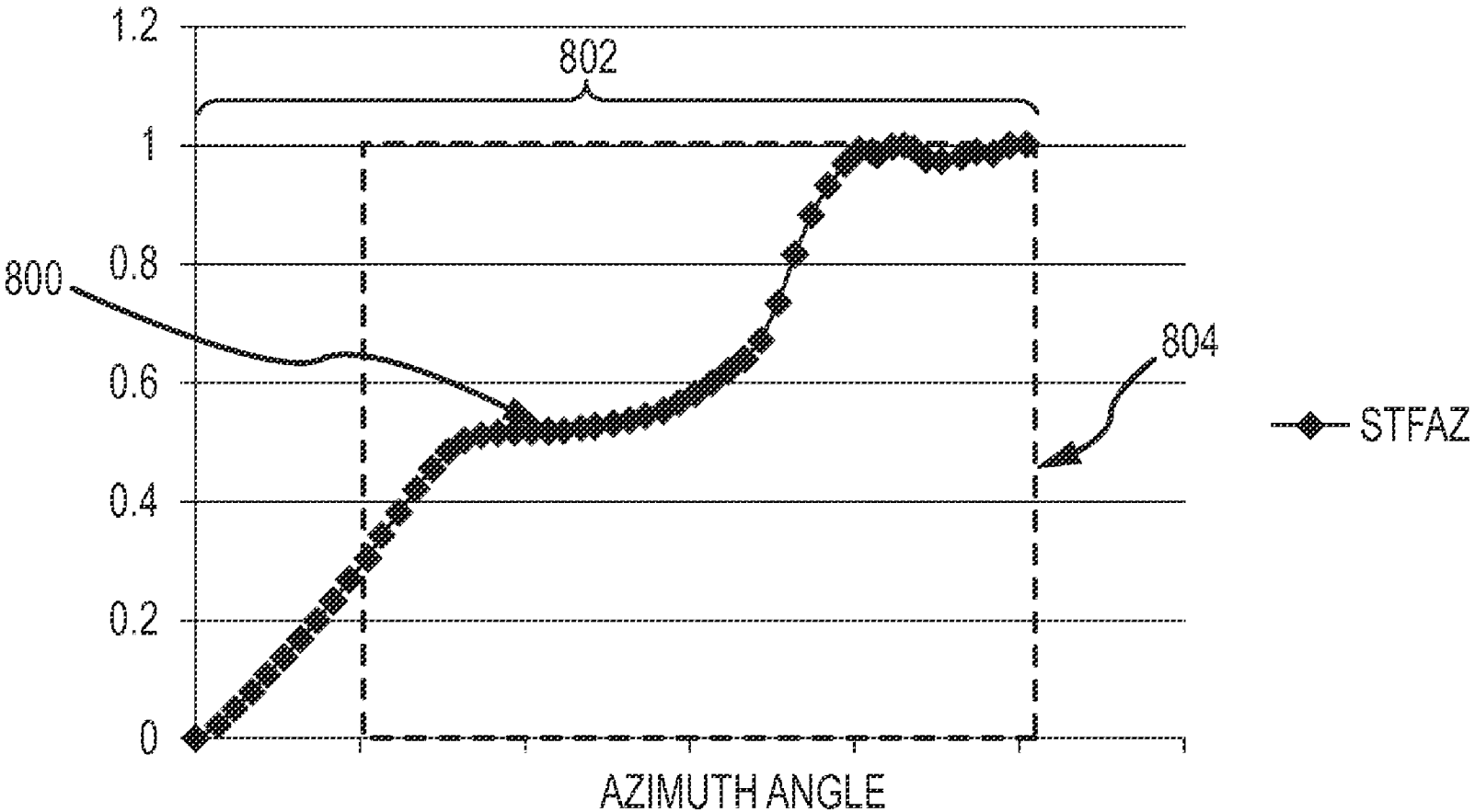
FIG. 8 is a diagram of the spatial transfer function for the WFOV using the matched filter to extend the central monotonic region.

Referring now to FIG. 8, a STF 800 for a detector employing a matched filter has a much wider central monotonic region 802 and has eliminated the non-monotonic or double-valued region. The matched filter has an extra degree of freedom as compared to the centroid calculation and thus can better account for and discriminate stray light. The matched filter effectively disambiguates the angle measurement in the extended non-monotonic (double-valued) region of the spatial transfer function corresponding to the centroid calculation. This approach recovers previously unusable transfer function space 804, hence FOV. In particular, this approach makes viable tactical situations for fixed-post guided projectiles in which the target is at close range and at relatively large angles off boresight.

Figure 9:
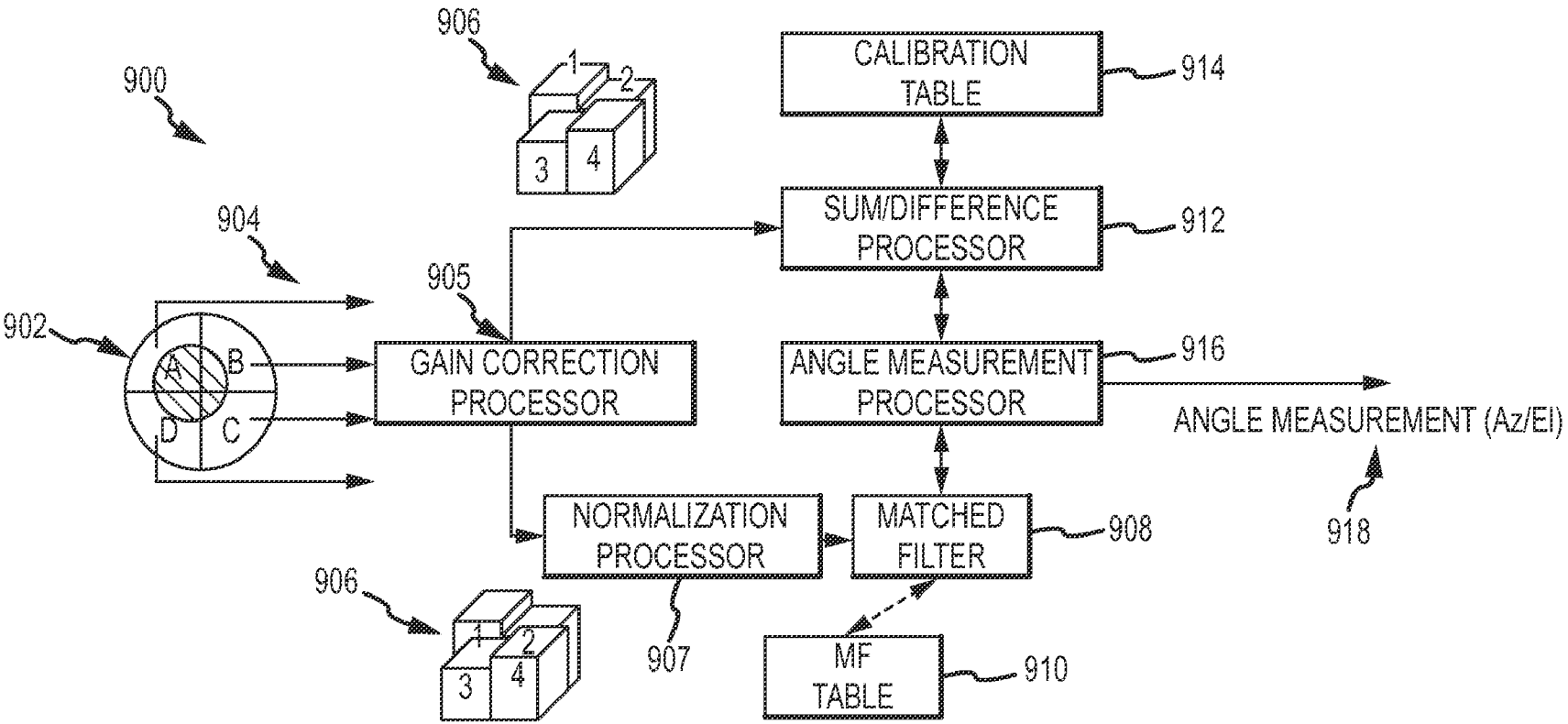
FIG. 9 is a block diagram of a detector that uses a matched filter to disambiguate angle measurements in the double-valued region of the quad-cell STF in accordance with the present invention.

Referring now to FIG. 9, a SAL detector 900 implements a hybrid of the centroid calculation and matched filter to generate the final angle measurement that is provided to the flight control system. The appropriate detector configuration will be driven by the tactical situation, on-board processing resources, the resolution and angle extent of the matched filter and the resolution and angle extent of the calibrated angle measurement table for the centroid calculation.

In general, SAL detector 900 comprises a multi-segment detector 902 such as a quad-detector that outputs measures 904 of incident laser light for each segment, a gain correction processor 905 (digital processor or analog circuit) that corrects the measures 904 via a gain correction that has been preloaded into the sensor. A normalization processor 907 normalizes the gain corrected amplitudes according to largest measure to produce a normalized response 906, a matched filter 908 that maps the normalized response to entries in a matched filter table 910 to extract the az/el angle, a sum/difference processor 912 that performs the centroid calculation on the gain corrected, but unnormalized channel amplitudes and extracts the corresponding az/el angle from a calibration table 914 and an angle measurement processor 916 that arbitrates between the matched filter 908 and sum/difference processor 912 in accordance with a particular detector configuration to output the angle measurement 918. The normalization and angle measurement processor are illustrated as separate functional processors. In practice, they may be implemented in separate processors or a single processor. The sum/difference processor may comprise either analog or digital circuitry.

Figure 10:
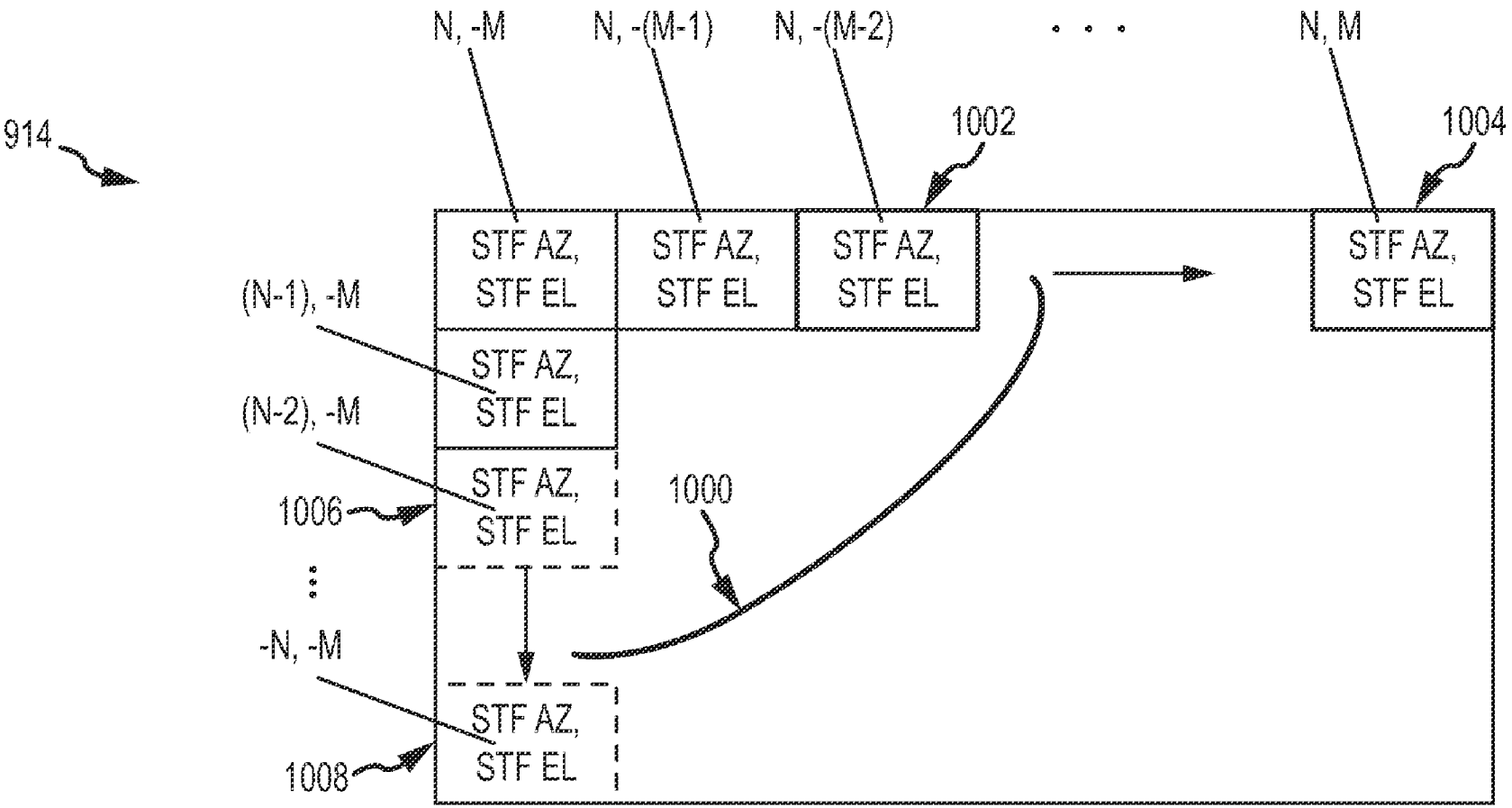
FIG. 10 is a calibration table of the single and double-value angle measurements for a quad-cell centroid calculation.

An example of calibration table 914 is depicted in FIG. 10. The table maps values of the STF (i.e. the calculated centroid values $\Delta X$ and $\Delta Y$) to the calibrated Azimuth and Elevation angles. As shown, in the central monotonic region of the STF the mapping from the STF value to the angle is 1-to-1, no ambiguity. In the extended non-monotonic region of the STF the mapping from the STF is ambiguous. The apex of the STF curve is denoted by curve 1000 and separates the double valued regions in the table If the detector has been calibrated over the full extent of the extended FOV, the STF value maps to two angles. If the detector has not been calibrated over the full extent of the extended FOV, the STF value maps to a lower measurement angle and an undetermined (UND) angle. AZ table values 1002 and 1004 are equal leading to ambiguity in the azimuth direction. EL table values 1006 and 1008 are equal leading to ambiguity in the elevation direction.

In a first case, detector 900 is configured to implement only the matched filter. The matched filter processes the normalized response 906 to select and output the measurement angles corresponding to the table entry that most closely matches the normalized response. The search of the matched filter may be constrained to the quadrant, or more generally segment, that exhibits the largest response.

In a second case, detector 900 uses sum/difference processor 912 to produce an estimated angle measurement or measurements if in the double-valued region. These measurements are then used by the angle measurement processor to constrain the search area of the matched filter. For example, if the centroid calculation produces a single measurement angle, the matched filter table may be searched at that measurement angle plus or minus a specified angle or number of table entries. If the centroid calculation produces a pair of measurement angles, the matched filter table may be searched at both angles plus or minus a specified angle or number of table entries. This approach improves the efficiency of searching the matched filter table. This approach would typically be used when the matched filter provides higher resolution angle measurements than does the centroid calculation. In theory, the matched filter should be able to provide higher measurement precision and resolution because of its additional degree of freedom.

In a third case, detector 900 uses the matched filter to disambiguate the measurement angle in the double-valued region of the centroid calculation. This approach would typically be used if the centroid calculation and calibration table provided higher resolution angle measurements than the matched filter. This approach may be implemented in several different ways depending on the extent of the FOV over which both the matched filter and centroid calculation are calibrated in their respective tables. Assuming both the matched filter and centroid have been calibrated over the full extent of the FOV, the angle measurement processor may use the output of the matched to select the appropriate angle measurement from the calibration table, particularly when the STF value maps to a double-valued angle. Now assume that the centroid has only been calibrated up to the apex of the STF leaving the larger angle measurement of all double-valued measurements undetermined. In this case, if the matched filter selects the smaller angle measurement the detector outputs the smaller angle measurement from the calibration table. However, if the matched filter selects the larger angle measurement the detector may be configured to either output the lower resolution angle measurement provided by the matched filter or to default to a direction only guidance signal.

In some cases it might also be advantageous to switch dynamically between the centroid and matched filter angular measurement techniques depending on the measured angle. Many varieties of this approach will occur to those skilled in the art.

Figure 11B:
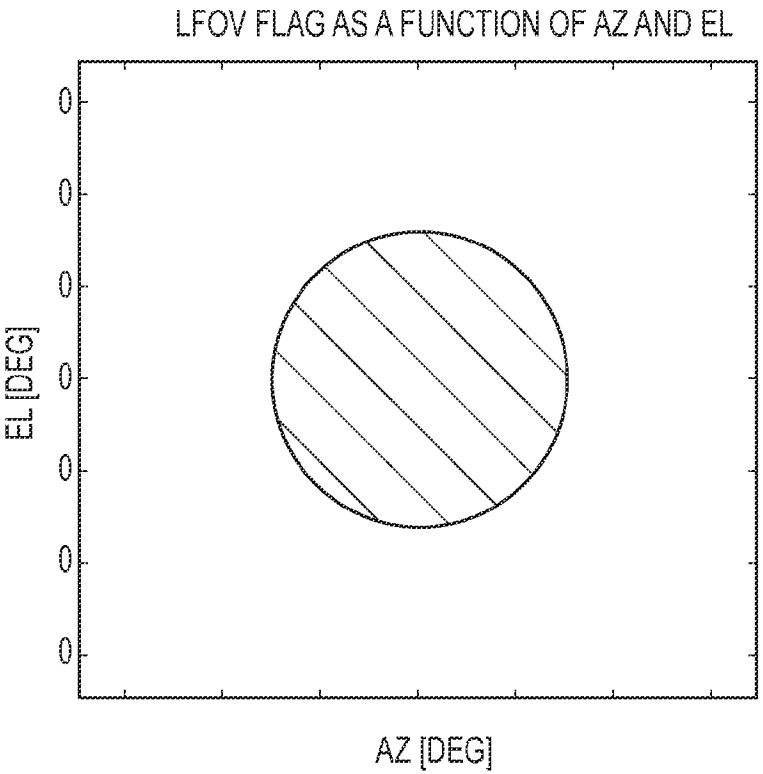
FIGS. 11*a* and 11*b* are plots of false alarm again elevation and azimuth angle for a conventional thresholding scheme and the matched filter approach of the present invention.
Figure 11A:
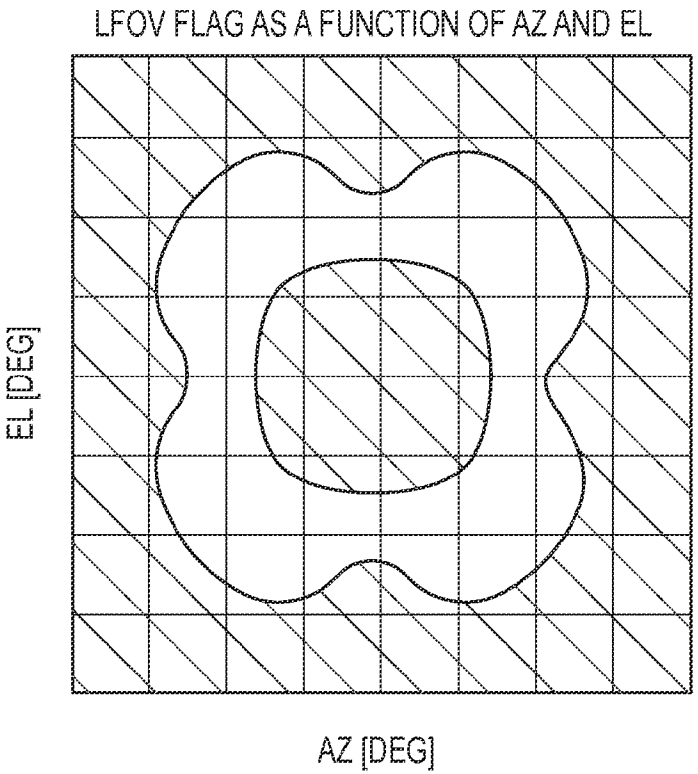

Referring now to FIGS. 11*a* and 11*b*, the performance of a thresholding scheme is compared to the matched filter approach in plots 1000 and 1002. Both figures display the probability that a target in the FOV will produce a signal that is determined to be in the monotonic region of the spatial transfer function curve. If the target position is determined to be in the monotonic region it is labeled with probability=1 shown as a "hatched" area. Alternatively if the target position is determined to be in the non-monotonic region it is labeled with probability=0 shown as white area. In FIG. 11*a* these are the only possible values since the threshold algorithm produces binary results. In FIG. 11*b*, the matched filter approach allows a probability between 0 and 1. It is clear that if a large central monotonic region is desired the thresholding method displayed in FIG. 11*a* will produce regions outside of the desired monotonic region (i.e. the double valued region) that are erroneously determined to be in the monotonic region. This is a direct result of trying to extend performance further into the double valued or non-monotonic region of the spatial transfer function. On the other hand the match filter method performs much better in this region, with a false alarm rate of less than 0.36%, centered on the axes of the quad cell detector used in measurement. The difference in performance between the two algorithms is dramatic. In the case of the threshold algorithm (FIG. 11*a*), the desired monotonic region must be decreased dramatically in order to minimize false alarms (probability=1 outside of the desired monotonic region). If this step is not taken extremely large angle measurement errors will be input into guidance processing, impacting the performance of the missile guidance significantly.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A semi-active laser (SAL) guided projectile, comprising:
a projectile;
one or more control surfaces on the projectile;
a dome that is mounted on one end of the body, said dome transmissive of laser energy;
a seeker mounted on the projectile behind the dome, comprising,
a non-imaging optical sub-assembly that focuses incident laser energy reflected off a target into a spot;
a detector comprising a plurality of segments, each segment responsive to incident laser energy to output a measure of the integrated energy;
means for normalizing the measures by dividing each measure by the largest measure to generate a normalized response;
a matched filter (MF) comprising a plurality of component matched filters at different angle measurements that span a field of view (FOV), each said component matched filter comprising a number of weights corresponding to the normalized response of the like number of segments of the detector for a particular angle measurement, said MF responsive to the normalized response to search the FOV and select the component matched filter and angle measurement; and
a flight control system that receives the angle measurement and generates control signals to manipulate the one or more control surfaces to control the flight of the projectile.

2. The SAL guided projectile of claim 1, wherein the seeker is fixedly mounted to the projectile.

3. The SAL guided projectile of claim 1, further comprising:
a spreader that spatially homogenizes laser energy transmitted through the optical sub-assembly to increase the spot size.

4. The SAL guided projectile of claim 3, wherein the spreader comprises a diffuser.

5. The SAL guided projectile of claim 1, wherein the angular resolution of the matched filter increases near the boundaries between detector segments.

6. The SAL guided projectile of claim 1, wherein the angular resolution of the matched filter is variable throughout the field of view of the sensor.

7. The SAL guided projectile of claim 1, wherein the matched filter selected the component matched filter based on a sum of absolute differences metric between the weights and the measured normalized response for each segment.

8. The SAL guided projectile of claim 1, wherein the matched filter selected the component matched filter based on a multiplication of absolute differences metric between the weights and the measured normalized response for each segment.

9. The SAL guided projectile of claim 1, wherein the matched filter selected the component matched filter based on a root sum square of differences metric between the weights and the measured normalized response for each segment.

10. The SAL guided projectile of claim 1, wherein the matched filter only searches the angle measures in the portion of the FOV corresponding to the segment with the largest measure to select the component matched filter.

11. The SAL guided projectile of claim 1, further comprising:
means for comparing the measures of the normalized response to calculate a spatial displacement of the centroid of the incident energy; and
a calibration table mapping spatial displacement to a single angle measurement in a central monotonic region of the FOV and to a pair of angle measurements in an extended non-monotonic region of the FOV;
said matched filter only searching neighborhoods of the single angle measurement of pair of angle measurements in the FOV to select the component matched filter.

12. The SAL guided projectile of claim 1, wherein the detector comprises a quad-cell detector that generates four measures, one measure for each cell.

13. The SAL guided projectile of claim 1, wherein the angle measurement output by the matched filter is provided to the flight control system.

14. The SAL guided projectile of claim 1, wherein further comprising:
means for comparing the measures of the normalized response to calculate a spatial displacement of the centroid of the incident energy; and
a calibration table mapping spatial displacement to a single angle measurement in a central monotonic region of the FOV and to a pair of low and high angle measurements in an extended non-monotonic region of the FOV;
said matched filter's output angle measurement selecting the angle measurement from the calibration table to disambiguate the pair of angle measurements in the extended non-monotonic region of the FOV,
said selected angle measurement from the calibration table being provided to the flight control system.

15. The SAL guided projectile of claim 14, wherein the high angle measurement is undetermined, if said matched filter selects said high angle measurement the angle measurement of the matched filter being provided to the flight control system.

16. The SAL guided projectile of claim 14, wherein the high angle measurement is undetermined, if said matched filter selects said high angle measurement a directional flag is provided to the flight control system.

17. A semi-active laser (SAL) guided projectile, comprising:
a projectile;
one or more control surfaces on the projectile;
a dome that is mounted on one end of the body, said dome transmissive of laser energy;
a fixed-post seeker mounted on the projectile behind the dome, comprising,
a non-imaging optical sub-assembly that focuses incident laser energy reflected off a target into a spot;
a spreader that spatially homogenizes laser energy transmitted through the optical sub-assembly to increase the spot size;
a quad-cell detector comprising four cells, each cell responsive to incident laser energy to output a measure of the integrated energy;
means for normalizing the measures by dividing each measure by the largest measure to generate a normalized response;
means for comparing the measures of the normalized response to calculate a spatial displacement of the centroid of the incident energy;
a calibration table mapping spatial displacement to a single angle measurement in a central monotonic region of the FOV and to a pair of angle measurements in an extended non-monotonic region of the FOV;

a matched filter (MF) comprising a plurality of component matched filters at different angle measurements that span a field of view (FOV), each said component matched filter comprising a number of weights corresponding to the normalized response of the like number of segments of the detector for a particular angle measurement; and an angle measurement processor that searches only neighborhoods of the single angle measurement or pair of angle measurements in the FOV corresponding to the spatial displacement of the centroid to select a component matched filter and angle measurement; and a flight control system that receives the angle measurement and generates control signals to manipulate the one or more control surfaces to control the flight of the projectile.

18. The SAL guided projectile of claim 17, wherein the angular resolution of the matched filter increases near the boundaries between detector segments.

19. The SAL guided projectile of claim 17, wherein the matched filter selected the component matched filter based on a sum of absolute differences metric between the weights and the measured normalized response for each segment.

20. The SAL guided projectile of claim 17, wherein said matched filter's output angle measurement selects the angle measurement from the calibration table to disambiguate the pair of angle measurements in the extended non-monotonic region of the FOV and provides the angle measurement from the calibration table to the flight control system.

21. The SAL guided projectile of claim 17, wherein said matched filter's angle measurement is provided to the flight control system.

22. A semi-active laser (SAL) detector, comprising:

a non-imaging optical sub-assembly that focuses incident laser energy reflected off a target into a spot;

a detector comprising a plurality of segments, each segment responsive to incident laser energy to output a measure of the integrated energy;

means for normalizing the measures by dividing each measure by the largest measure to generate a normalized response; and a matched filter (MF) comprising a plurality of component matched filters at different angle measurements that span a field of view (FOV), each said component matched filter comprising a number of weights corresponding to the normalized response of the like number of segments of the detector for a particular angle measurement, said MF responsive to the normalized response to search the FOV and select the component matched filter and angle measurement.

23. The SAL detector of claim 22, further comprising:

means for comparing the measures of the normalized response to calculate a spatial displacement of the centroid of the incident energy;

a calibration table mapping spatial displacement to a single angle measurement in a central monotonic region of the FOV and to a pair of angle measurements in an extended non-monotonic region of the FOV;

an angle measurement processor that searches only neighborhoods of the single angle measurement or pair of angle measurements in the FOV corresponding to the spatial displacement of the centroid to select a component matched filter and angle measurement.

* * * * *